US007188384B2

(12) United States Patent
McKay

(10) Patent No.: US 7,188,384 B2
(45) **Date of Patent: *Mar. 13, 2007**

(54) LINT REMOVAL APPARATUS WITH PULL TAB FOR ADHESIVE COATED SHEETS

(75) Inventor: William D. McKay, Gland Blanc, MI (US)

(73) Assignee: The Hartz Mountain Corporation, Secaucus, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/282,534

(22) Filed: Nov. 18, 2005

(65) Prior Publication Data

US 2006/0112507 A1 Jun. 1, 2006

Related U.S. Application Data

(63) Continuation of application No. 10/120,726, filed on Apr. 11, 2002, which is a continuation-in-part of application No. 10/080,089, filed on Feb. 21, 2002, now Pat. No. 6,954,963.

(51) Int. Cl.
*A47L 25/00* (2006.01)

(52) U.S. Cl. ..... 15/104.002; 428/192; 428/343

(58) Field of Classification Search ..... 15/104.002, 15/230.11; 428/192, 343
See application file for complete search history.

(56) References Cited

U.S. PATENT DOCUMENTS

| | | | | |
|---|---|---|---|---|
| 2,271,189 | A | 1/1942 | Garthwait | |
| 2,506,333 | A | 5/1950 | Bedynek | |
| 2,612,336 | A | 9/1952 | Tuttle | |
| 3,056,154 | A | 10/1962 | Neal | |
| 3,158,887 | A | 12/1964 | Kanbar et al. | |
| 3,299,461 | A | 1/1967 | Marks | |
| 3,373,457 | A | 3/1968 | Rouch, Jr. | |
| D216,942 | S | 3/1970 | Safalow | |
| 3,665,543 | A | 5/1972 | Nappi | |
| 3,742,547 | A | 7/1973 | Sohmer | |
| D238,127 | S | 12/1975 | Snyder | |
| 4,062,083 | A | 12/1977 | McKay | |
| 4,107,811 | A | 8/1978 | Imsande | |
| 4,320,158 | A * | 3/1982 | Seeley | 428/42.3 |
| 4,361,923 | A | 12/1982 | McKay | |
| 4,399,579 | A | 8/1983 | McKay | |
| 4,422,201 | A | 12/1983 | McKay | |
| 4,489,912 | A | 12/1984 | Haythornthwaite | |
| 4,519,566 | A | 5/1985 | Manzi | |
| 4,727,616 | A | 3/1988 | Kucera et al. | |
| 4,905,337 | A | 3/1990 | McKay | |
| D311,995 | S | 11/1990 | Garcia | |
| D314,282 | S | 2/1991 | Gingras | |
| 5,027,465 | A | 7/1991 | McKay | |
| D320,680 | S | 10/1991 | Stetson et al. | |
| D342,610 | S | 12/1993 | Stetson et al. | |
| D363,214 | S | 10/1995 | Parola et al. | |
| 5,878,457 | A | 3/1999 | Cox et al. | |

(Continued)

*Primary Examiner*—Randall Chin
(74) *Attorney, Agent, or Firm*—Gottlieb, Rackman & Reisman

(57) ABSTRACT

A pull tab is formed at a separable edge of each of a plurality of individually separable sheets of outwardly faced adhesive tape wound into a roll by a non-adhesive portion carried on the adhesive layer of the tape to facilitate gripping and removal of an outermost sheet from the tape roll to expose an underlying sheet. The separable edges extend at least partially through the tape roll dividing the tape into a plurality of separable sheets and across substantially all of the lateral extent of the roll. The separable edge can be two spaced separable edges disposed in registry with each non-adhesive portion to define opposite leading edges.

16 Claims, 9 Drawing Sheets

U.S. PATENT DOCUMENTS

| | | | | |
|---|---|---|---|---|
| 5,940,921 | A | 8/1999 | Wood et al. | |
| D419,306 | S | 1/2000 | Hansen et al. | |
| 6,014,788 | A | 1/2000 | Jaffri | |
| 6,055,695 | A | 5/2000 | McKay, Jr. | |
| 6,127,014 | A | 10/2000 | McKay, Jr. | |
| D441,538 | S | 5/2001 | Petner | |
| D446,023 | S | 8/2001 | Sherman | |
| 6,298,517 | B1 | 10/2001 | McKay | |
| 6,321,408 | B1 | 11/2001 | Esterson et al. | |
| 6,756,102 | B1 | 6/2004 | Galo | |
| 2002/0088070 | A1* | 7/2002 | Cho | 15/104.002 |
| 2002/0144367 | A1 | 10/2002 | McKay, Jr. | |
| 2003/0096074 | A1 | 5/2003 | Kim | |
| 2004/0154133 | A1 | 8/2004 | Polzin et al. | |
| 2004/0194240 | A1 | 10/2004 | McKay, Jr. | |

* cited by examiner

LINT REMOVAL APPARATUS WITH PULL TAB FOR ADHESIVE COATED SHEETS

CROSS REFERENCE TO CO-PENDING APPLICATION

This application is a Continuation Application of U.S. application Ser. No. 10/120,726, filed Apr. 11, 2002, now pending, which is a continuation-in-part of Ser. No. 10/080,089, filed Feb. 21, 2002, now U.S. Pat. No. 6,954,963, the contents of which are incorporated herein in its entirety.

BACKGROUND

This invention relates generally to tools for picking up particles from surfaces such as clothing, pets, floors, carpets, furniture, and more specifically, to an adhesive tape lint remover having removable cleaning sheets.

FIELD OF THE INVENTION

Surfaces such as floors, clothing, pets, and furniture are most aesthetically pleasing and safe when they are clean, free from unsightly particles. Unfortunately these surfaces typically become soiled with particles from the environment, such as pets shedding hair, settling dust particles, dandruff from dry scalps and pets. Numerous devices and methods have been developed for returning a surface to a clean, particle free condition and people are constantly striving to develop better methods. Sweeping, brushing, vacuuming or using adhesive tape lint removers work well. However, most suffer from the drawback of being time consuming and difficult. For example, a small piece of lint, dandruff or hair may be located on an article of clothing or floor. Using a vacuum requires a person to locate the vacuum cleaner, uncoil and plug in a power cord, select the correct attachments, vacuum up the hair or lint and reverse the process to put the vacuum cleaner away. Likewise using a brush simply moves particles from one surface to another and requires either picking the hair or lint up from another surface or cleaning the brush. Alternatively a person may use an adhesive tape lint remover. This is also undesirable for many people since it is difficult to grasp individual layers and remove one at a time. Some persons may find locating and grasping individual sheets difficult and uncomfortable as they have physical limitations. Other people may find the dry edges unacceptable as they reduce the quantity of adhesive surface area for cleaning. Therefore, there is a need for improved devices and methods for simple cleaning duties such as removing lint, pet hair, and dandruff from clothing or floors. Previous attempts to address this need include lint removal brushes with directional fabric, adhesive tape lint removers with non-adhesive edges, electrostatic charged dusting cloths, and small hand held vacuum cleaners. However these solutions do not adequately address the needs of typical homeowners.

SUMMARY OF THE INVENTION

The present invention is a lint removal apparatus including a tape roll in which a unique pull tab is formed along the tape roll at the location of the separable edge defining each individual sheet of the tape roll to facilitate gripping and removal of an outermost sheet from the next underlying inner sheet.

In one aspect, the lint removal apparatus includes:

a tape wound in a roll and formed of a substrate having opposed side edges and first and second major opposed surfaces of the tape;

an adhesive layer carried on one major surface;

the tape wound into a tape roll with the adhesive layer facing outwardly from the roll;

a separable edge extending at least partially through the roll dividing the roll into a plurality of individually separable sheets; and a plurality of pull tabs formed by non-adhesive portions extending substantially laterally between side edges of the tape roll and on one surface of the tape, each non-adhesive portion disposed in registry with the separable edge to define one pull tab on each sheet to facilitate removal of an outermost sheet from the roll.

The unique pull tab of the present invention provides advantages for a lint removal tape roll by enabling easy gripping and removal of an outermost soiled sheet from the next innermost clean sheet of the tape roll without pulling additional sheets from the roll or having to pry the exposed end edge of the outermost sheet from the underlying adhesive coated layer. The pull tab defines a minimal non-adhesive area on the tape roll thereby providing greater exposed adhesive surfaces on each tape roll sheet as compared to prior lint removal tape rolls having dry edges along at least one and typically both side edges of the tape.

BRIEF DESCRIPTION OF THE DRAWINGS

The various features, advantages and other uses of the present invention will become more apparent by referring to the following detailed description and drawing in which.

DETAILED DESCRIPTION

Figure 1:
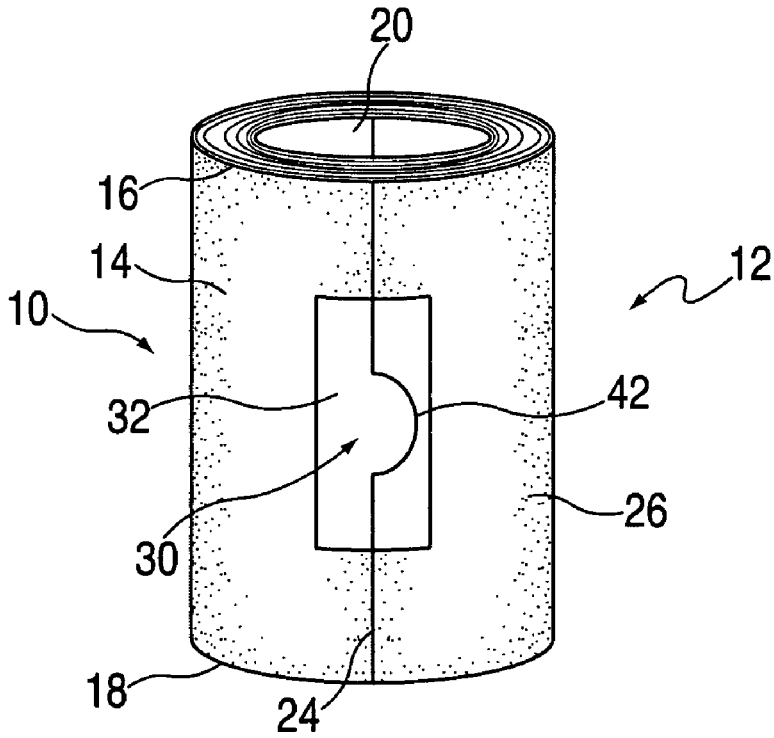
FIG. 1 is a perspective view of a lint removal apparatus according to one aspect of the present invention.

Referring now to FIG. 1, there is depicted a tape roll 10 for a lint removal apparatus 12 according to the present invention. The tape 14 wound into the roll form 10 is preferably formed of at least two material layers, one constituting a substrate or backing layer and the other constituting an adhesive layer, both having opposed side edges 16 and 18 and opposed, major, first and second surfaces 20 and 22.

The substrate 14 is formed of a suitable material; such as silicone coated flat backed paper or crepe paper or plastic film. Any, suitable paper and plastic films, known in the relevant industry, may be employed. The substrate 14 can be opaque, transparent, colored or have printed indicia thereon as well as being formed with different surface textures or embossments.

The adhesive layer is disposed on or applied to substantially all or one major surface 20 or 22 of the substrate 14. According to the present invention, the adhesive layer is applied to the substantially all of one major surface 20 or 22 of the substrate 14 between the side edges 16 and 18.

Suitable adhesives which form a tacky, partially pressure sensitive surface for picking up lint and debris from other surfaces as generally known in the relevant industry may be employed. Typically, such adhesives are known as "pressure sensitive" adhesives and are normally tacky at room temperature. Such adhesives can be adhered to a surface by the application of light pressure.

Further details concerning the types of materials which can used to form the substrate 14 and the adhesive layer may be found by referring to U.S. Pat. No. 5,027,465, the relevant portions of which pertaining to the substrate and adhesive materials are incorporated herein by reference.

As shown in FIG. 1, the tape 10 is wound into a continuous roll about a core or in a coreless fashion. An interior bore 20 is formed in the roll 10 for the core, if used, and/or for receiving a rotatable handle element as described hereafter and shown in FIGS. 13 and 14.

A separable edge 24 is formed substantially through the roll 10 at one location between the side edges 16 and 18. The separable edge 24 divides the tape 10 into a series of end to end arranged sheets 26. As described hereafter, the outermost sheet 26 may be removed from the roll 10 after it is soiled thereby to enable a new clean sheet 26 to replace the soiled and removed outer sheet on the exterior surface of the roll 10.

Figure 2:
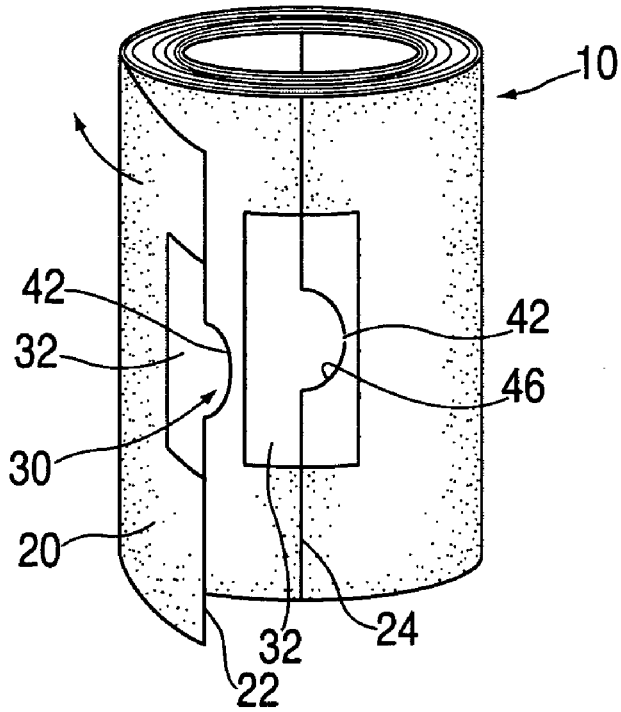
FIG. 2 is a perspective view of the lint removal apparatus of FIG. 1 shown at the beginning of the outermost sheet removal from the roll.
Figure 3:
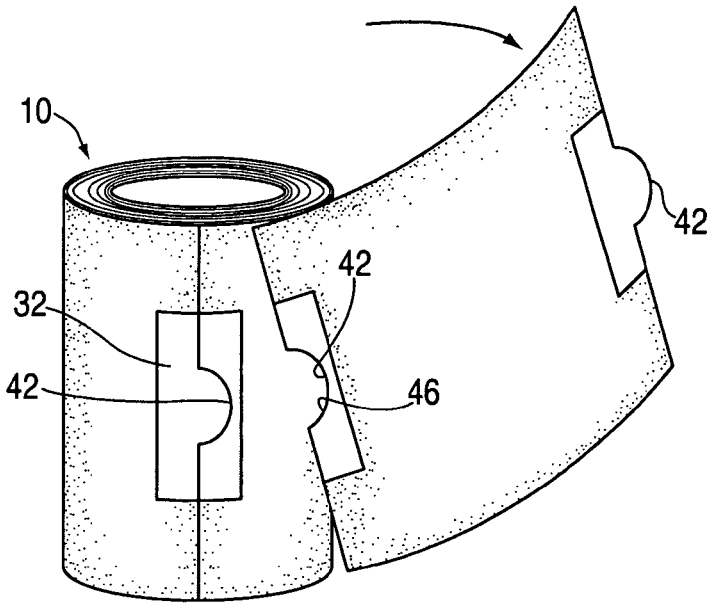
FIG. 3 is a perspective view of the lint removal apparatus of FIGS. 1 and 2, showing the complete separation of an outermost sheet from the roll.

According to the present invention, a unique pull tab denoted in general by reference number 30 is provided in registry with the separable edge 24 of each sheet 26. One portion of the pull tab 30 extends across the edge 24 so it can be easily separated from the surrounding adhesive on the underlying sheet 26 to allow the edge 24 of the outer most sheet 26 to be pulled away from the roll 10 as shown in FIGS. 2 and 3, unwound and removed from the roll 10.

Figure 4:
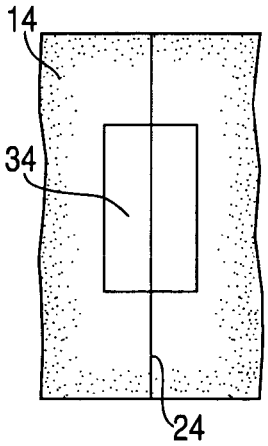
FIG. 4 is a partial, plan view of one aspect of a pull tab according to the present invention.
Figure 5:
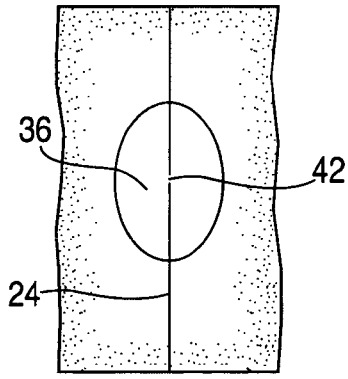
FIG. 5 is a partial, plan view of another aspect of the pull tab of the present invention.

The pull tab 30, shown and described hereafter in many different aspects, is part of a substantially non-adhesive area 32 which is formed by various means, also described hereafter, on the adhesive layer of each sheet 26. Preferably, the non-adhesive area 32 is disposed in registry with the separable edge 24 of each sheet 26 from the roll 10. The term "registry" will be understood to encompass configurations where the area 32 of the pull tab 30 overlays and spans the separable edge 24 or is disposed in substantial contact or spaced a small distance up to ½ inch from the edge 24 with a portion of the edge 24 such that the entire area 32 extends away from the edge 24 and does not span the edge 24. As shown in FIGS. 4 and 5, the non-adhesive area 32 can take different configurations, such as a polygonal configuration 34 shown in FIGS. 1–4, and 6–10, where the area 32 has a square, rectangular or other polygonal shape, or a circular configuration 36 as shown in FIG. 5. The non-adhesive areas 32 can also be provided in a color different than the color of the tape or printed with indicia, such as "pull here".

The pull tab 30 can be formed in a number of different ways, each defining a tab adjoining a part of the sheet 26 on the roll 10' but which has a non-adhesive radially outermost surface to allow the pull tab 30 on the outermost sheet 26 to be easily grasped and pulled to facilitate removal of the outer sheet 26 from the roll 10.

For example, the non-adhesive area 32 can be formed of a thin material layer or sheet, including, but not limited to, plastic films, non-woven fabrics, papers, Tyvek, which has at least one substantially non-adhesive surface. Alternately, the non-adhesive area 32 can be formed of a coating, such as a UV cured or fast drying material, such as silicone or varnish, or a transferable ink including a stamped or jet sprayed ink. According to the present invention, "non-adhesive" area means an area or surface which has or is formed of a partial or complete non-adhesive surface or coating. For example, silicone or varnish can be screened onto the adhesive layer so as to cover a portion of the adhesive layer, i.e. 90%, for example, and thereby provide a slightly tacky surface which can assist in pulling the next pull tab away from the tape roll 12.

Further, the non-adhesive area 32 is formed on the roll 10 in the location of each separable edge 24 between adjacent wound sheets 26 so that the pull tabs 30 and non-adhesive areas 32 overlay each other. The non-adhesive areas 32 are longitudinally spaced along the length of the tape 12 the spacing between consecutive non-adhesive areas 23 can be equal or non-equal. The non-adhesive areas 32, while depicted as being centered between the side edges 16 and 18 of the tape 12, can be formed at any other position between the side edges 16 and 18.

Alternately, the pull tab 30 can be defined as a non-adhesive portion of the substrate of the tape 12 wherein the area 32 is masked or blocked off from the application of adhesive to the substrate during the coating of the substrate of tape 12.

As described above, the pull tab 30 may be formed on different combinations of area configurations, such as areas 32, 34 and 36 as well as different edge shapes as described hereafter.

In FIGS. 1 and 4, the separable edge 24 between adjacent sheets 26 on the roll 10 extends completely through the roll 10. The pull tab 40 which overlays the non-adhesive area 34 in FIG. 4 enables a user to insert his or her finger or fingernail beneath the edge 24 and raise the end of the tab 40 away from the roll 12.

The separable edge 24 may also be discontinuous as shown by the discontinuous line 42 in FIG. 5 which is formed between two continuous severed or slit portions extending at least partially through the entire roll 10. The discontinuity 42 defines a bridge which assists in maintaining the integrity of the slit or cut in the tape roll 10. It is known that some roll tapes have memory which is defined as the tendency of the tape to return to its original elongated shape prior to winding into a roll. This shape memory can make the tape roll open up at the slit or "butterfly." The bridge 42 assists in maintaining the roll 24 in its desired wound shape. This is shown more clearly in FIGS. 2 and 3 where the discontinuity or bridge 42 remains connected to the underlying clean sheet 26 until the outer soiled sheet is completely unwrapped from the roll 10. Just before the outer sheet 26 completely separates from the roll 10, the bridge 42 then rips away and actually lifts the pull tab 30 radially outward thereby providing easy access to the next sheet 26 to be removed when soiled.

Figure 7:
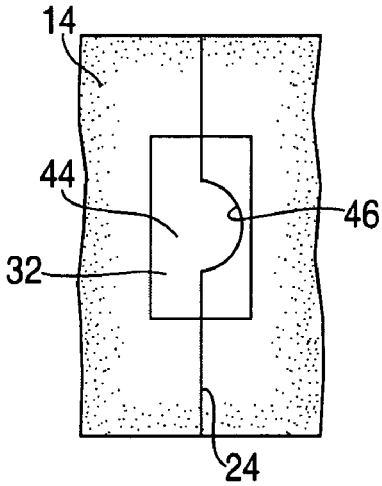
FIG. 7 is a partial, plan view of another aspect of the pull tab of the present invention.

FIG. 7 depicts a pull tab 44 which is formed by a notch 46, in the form of a semi-circle, in the separable edge 24. The notch 46 overlays the non-adhesive area 32 and provides the tab 44 for a user's finger to begin the separation of the outer sheet 26 from the roll 10.

Figure 8:
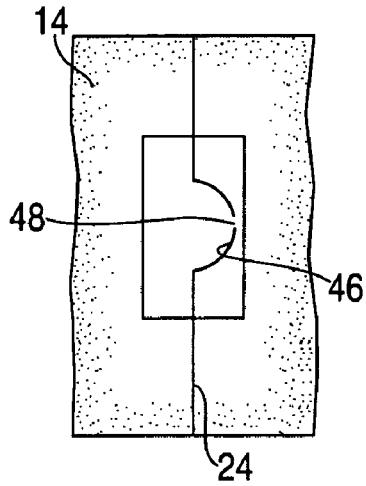
FIG. 8 is a partial, plan view of another aspect of the pull tab of the present invention.

In FIG. 8, the notch 46 is provided with a discontinuity which acts as a bridge 48 as described above for the bridge 42 shown in FIG. 5.

Figure 9:
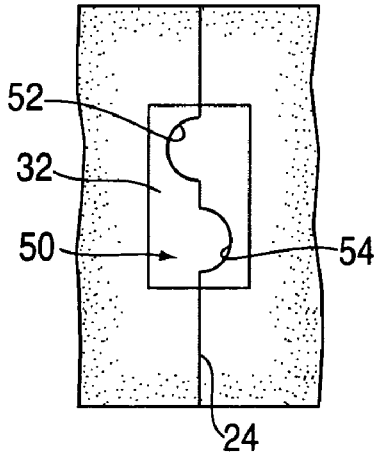
FIG. 9 is a partial, plan view of another aspect of the pull tab, of the present invention.

In FIG. 9, a pull tab 50is disclosed in which a portion of the separable edge 24 overlaying the non-adhesive area 32 is provided with two oppositely directed notches 52 and 54, each shown in the form of a semi-circle, by example only. Such recess 52 and 54 provides a tab 53 and 55, respectively, which can be engaged by the user's fingers.

Figure 10:
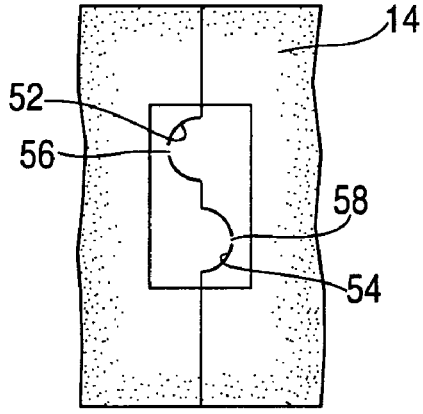
FIG. 10 is a partial, plan view of another aspect of the pull tab of the present invention.

In FIG. 10, the recesses 52 and 54 are illustrated as including a discontinuity or bridge 56 and 58, respectively. The bridges 56 and 58 function in the same manner as the discontinuities or bridges 42 and 48 described above.

Referring back to FIG. 6, the separable edge 60, in this aspect of the invention, is formed as a score line or series of perforations including alternating connected and disconnected, severed or partially severed slits 62 extending at least partially through the roll 10 and the non-adhesive area 32.

Figure 6:
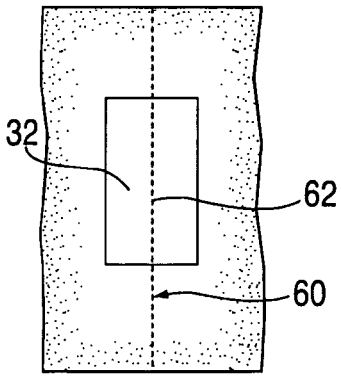
FIG. 6 is a partial, plan view of another aspect of the pull tab of the present invention.

It is also possible to redefine the shape of the perforations 62 shown in FIG. 6 by providing a larger discontinuity in the central portion of the edge of the perforation 60 generally overlaying a large portion of the pull tab area 32. This larger discontinuity acts as a separable connecting bridge as described above.

Figure 11A:
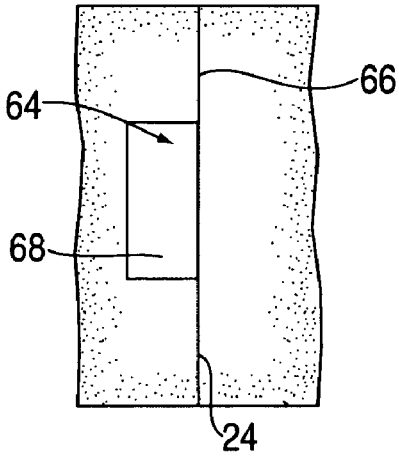
FIG. 11A is a partial, plan view of another aspect of the pull tab of the present invention.

In FIG. 11A, a pull tab 64 is disclosed in which an edge 66 of the entire non-adhesive area 68 defining the pull tab 64 is disposed in registry with the separable edge 24 extending through the roll 10. The non-adhesive area 68 still defines an easy access point for the user's finger to engage the portion of the edge 24 of the outermost sheet to begin separation of the outermost sheet 26 from the roll 10.

Figure 11B:
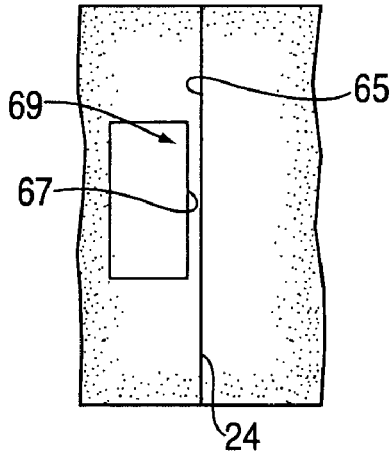
FIG. 11B is a modification of the pull tab shown in FIG. 11A.

In FIG. 11B, pull tabs 65 is shown in which the edge 67 of the non-adhesive area 69 defining the pull tab 65 is spaced a short distance of 1/32–1/2 inch from the separable edge 24. Although a small strip of adhesive exists between the separable edge 24 and the closest edge of the non-adhesive portion 69, the short width of the adhesive strip provides only a minimal amount of adhesion which can be easily broken by the user when grasping the separable edge 24 to separate the edge of the outermost strip from the roll 10.

All of the different pull tab configurations described above operate in the same manner to enable easy removal of an outermost sheet 26 from the roll 10.

As shown in FIGS. 2 and 3, the user grasps a portion of the pull tab 30 overlaying the non-adhesive area 32 to the left side of the separable edge 24 in the orientation shown in FIG. 2 and exerts a radially outward pulling force to separate one edge of the outermost sheet 26 from the roll 10. The outermost sheet is unwound from the roll 10 until the other end of the sheet 26 pulls free of the roll 10 as shown in FIG. 3. This leaves a new, clean outermost sheet 26 having one portion of the non-adhesive area 32 on one side of the separable edge and another portion of the non-adhesive area 32 on the other side of the edge 24.

The pull tabs and non-adhesive areas have been described as being formed on an outermost surface of the sheets 26 when the sheets are wound in the form of the roll 10. It is also possible to mount the pull tabs and the non-adhesive areas on the back surface of each sheet 26 when the sheets 26 are wound into the roll 10. However, since the back surface of the sheets already have a limited amount of non-adhesive qualities so as to enable an easy pulling of an outermost sheet 26 from the underlying sheet 26 during removal of the outermost sheet from the roll 10, the non-adhesive areas would have to have a greater non-adhering capability so as to permit easier release or actually a total lack of adhesion between the outermost sheet and an underlying sheet in the non-adhesive area.

Figure 12A:
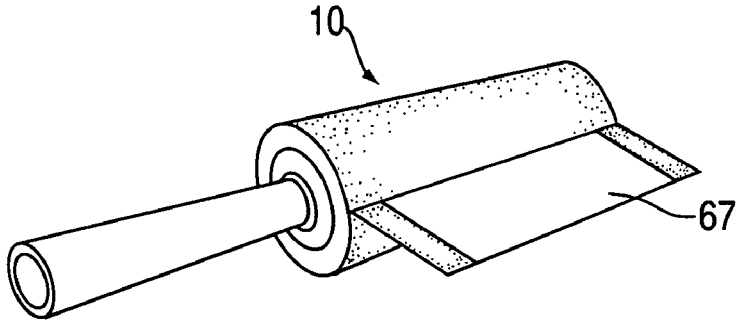
FIGS. 12A and B are perspective views of pull tabs carried on the back or under surface of the tape roll.
Figure 12B:
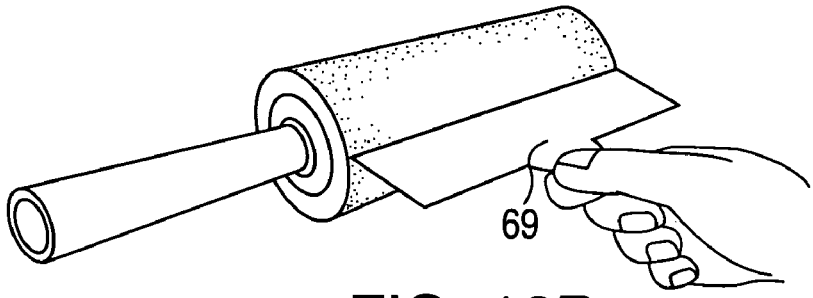

It is also possible in an aspect of the invention to form the pull tabs on the back surface of each sheet 26, and to have pull tabs 69 formed intermittently in a longitudinally spaced manner as shown in FIG. 12A in the same manner as the formation of the pull tabs on the outer surface of the sheets 26 as well as in a continuous longitudinal stripe along the entire longitudinal extent of the back surface of the tape as shown in FIG. 12B.

Figure 13:
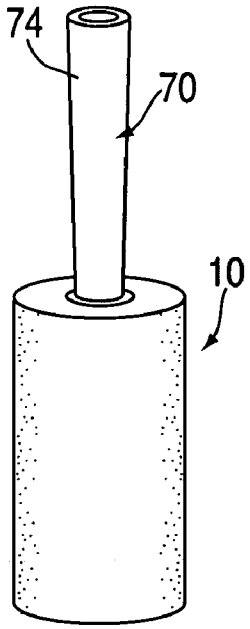
FIG. 13 is a perspective view of the lint removal apparatus of the present invention mounted on a one aspect of a handle.
Figure 14:
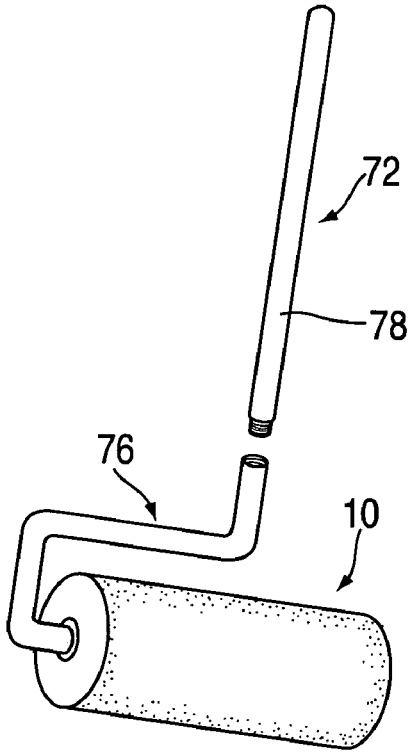
FIG. 14 is a perspective view of the lint removal apparatus of the present invention mounted on another aspect of a handle.

FIGS. 13 and 14 disclose alternate handles 70 and 72, respectively, which may be used to conveniently manipulate the tape roll 10 to pick up debris, dirt, lint, etc. The handle 70 has an end portion which defines a hand grip 74. An opposite end portion, not shown, releasably receives the roll 10, typically in a press fit, by example only. In FIG. 14, the handle 72 has a bent end portion 76, one end of which releasably receives the roll 10, such as in a press fit, by example only. The bent end portion 76 can have a continuous, elongated hand grip portion 78. Alternately, as shown in FIG. 14, the hand grip portion 78 is releasably attachable to the bent portion 76 so that the handgrip portion 78 functions as an extension. Threads, snap together, press fit, connections, etc., may be employed between the handgrip portion 78 and the bent portion 76.

Referring now to FIGS. 15–22, there are depicted different aspects of a pull tab for a lint roller. It will be understood that in FIGS. 15–22, the lint roller 10 is constructed in the same manner as the lint roller 10 described above and shown in FIGS. 1–14 in terms of structure, material composition and use. Only the shape of the separable edge(s) and the pull tab(s) are different.

Figure 15A:
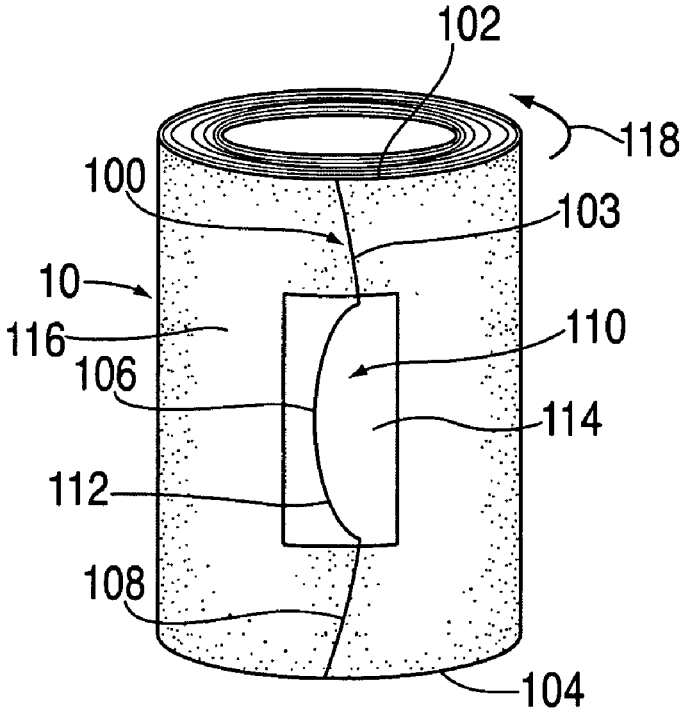
FIG. 15A is a perspective view of another aspect of a tape roll with a pull tab according to the present invention.

In the aspect shown in FIG. 15A, a separable edge 100 denoted generally by reference number 100 extends at least partially through the roll 10 and substantially completely from one side edge 102 to the opposite side edge 104 of the roll 10.

In this aspect of the invention, the separable edge 100 is formed of three separate segments or portions including a first segment 103 extending from the side edge 102 in a straight or arcuate line, an intermediate segment 106 extending from one end of the first segment 103 and having a smoothly curved arcuate shape, by example only, and a third segment 108 extending from one end of the second or intermediate segment 106 to the opposite side edge 104 of the roll 10. It will be understood that the intermediate or second segment 106 has a generally concave or convex shape depending upon the direction of viewing.

The tape roll 10 includes a plurality of longitudinally spaced, non-adhesive portions 110 constructed in the same manner as described in the previous aspects of the invention. Each non-adhesive portion 110, which is formed on the either of the front or back surfaces of the strip forming the roll 10, is located in registry with at least a portion of the second intermediate segment 106 of the separable edge 100. As shown in FIG. 15A, the non-adhesive portion 110 preferably spans the second segment 106 to form first and second non-adhesive sections 112 and 114, each separated by the second segment 106 of the separable edge 100.

Is should be noted that the non-adhesive portions 110 on the front or adhesive coated surface of the tape roll 10 are discrete areas of the tape roll 110, the non-adhesive portions 110 can be formed of a single release coating or an increased thickness release coating in addition to the primary release coating typically applied to the back surface.

Due to the winding of the strip into the roll 10, the non-adhesive section 112 oriented to the left of the second segment 106 of the separable edge 100 is formed at one end of one outermost strip 116 of the roll 10. The opposed non-adhesive section 114 to the right of the second segment 106 is formed on the opposite end of the outermost strip 116.

In use, when the outermost strip 116 extending counter-clockwise from the separable edge 100 in the direction of arrow 118 is grasped by the user inserting his or her fingernail beneath the edge of the second segment 106 at the non-adhesive portion 110 and peeling the separable edge 110 away from the roll 10, the outermost strip 116 is unwound and separated from the roll 10 thereby exposing a fresh sheet.

In the aspect of the tape roll 10 shown in FIG. 15A, the second segment 106' of the separable edge 100 is joined to the first and third segments 103 and 108 at ends extending laterally outside of the lateral extent of the non-adhesive portion 110.

Figure 16:
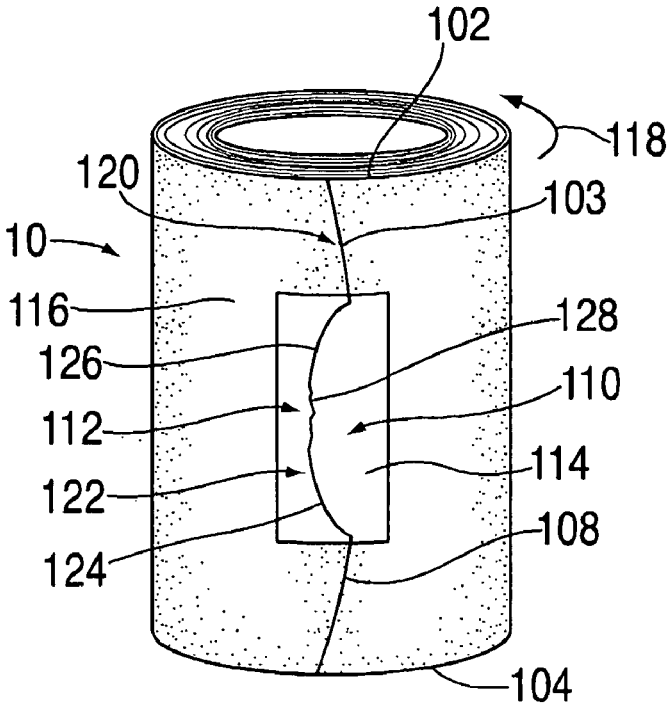
FIG. 16 is a perspective view of another aspect of a tape roll with a tear away pull tab according to the present invention.

In another modification of the tape roll 10 shown in FIG. 15A, a separable edge 120 in FIG. 16 also includes first and second generally straight or arcuate end segments 103 and 108 extending inward from the opposed side edges 102 and 104, respectively, of the roll 10. In this aspect, the separable edge 120 has a second intermediate segment 122 defined by end cut sections 124 and 126 in an intermediate tearable section 128 which is nominally affixed to and spans the separable edge 120 to removably join the two sections 112 and 114 of the non-adhesive portion 110. The tearable section or bridge 128 can be ripped apart to enable the outermost sheet 116 to be unwound in the direction of arrow 118 from the roll 10 to expose a fresh underlying sheet.

Figure 15B:
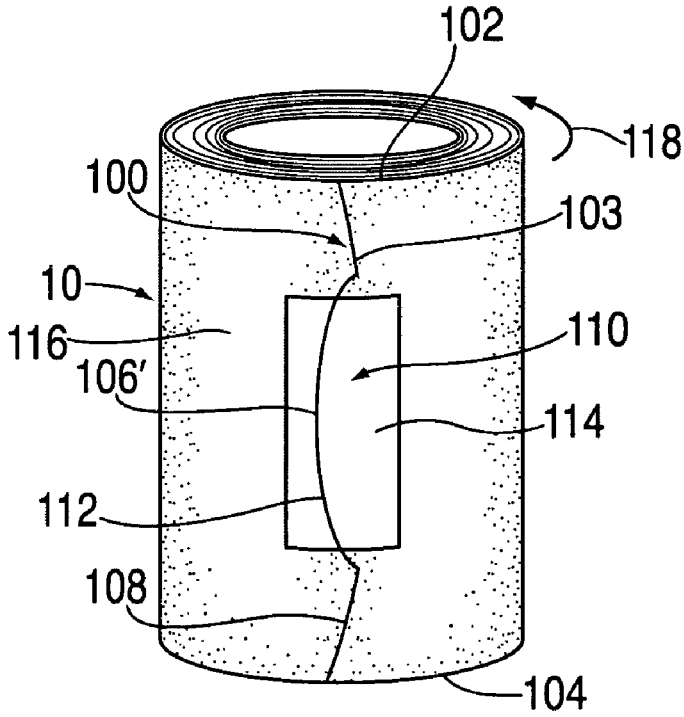
FIG. 15B is a perspective view of a modification of the tape roll shown in FIG. 15A.

It will be understood that in both aspects of the intermediate segment 106 or 122 of the separable edges 100 and 120, respectively, in the tape roll 10 shown in FIGS. 15 and 16, the contour of the intermediate segment 106 or 122 can also extend in an opposite direction or to the right from that shown in FIGS. 15A and 16.

Figure 17:
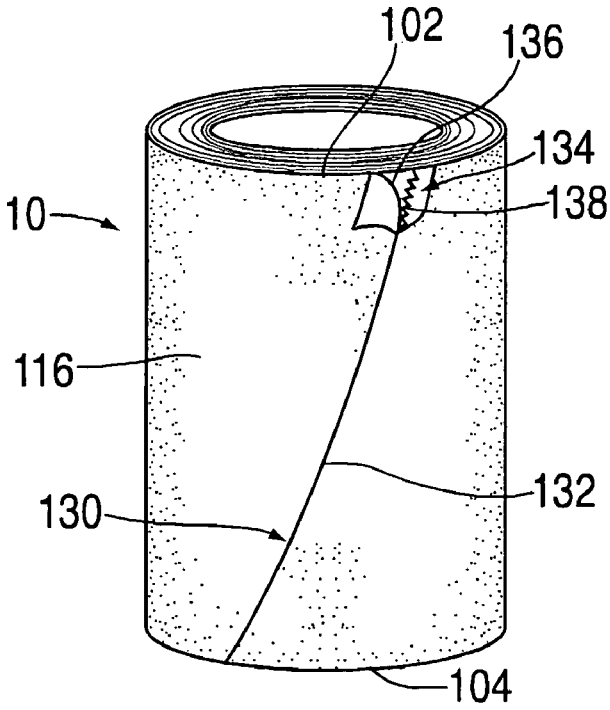
FIG. 17 is a perspective view of yet another aspect of the present invention showing a pull tab located adjacent one side edge of a tape roll.

Another aspect of a tape roll 10 is shown in FIG. 17. In this aspect, a separable edge 130 has a linear or arcuate portion 132 extending from one side edge, such as side edge 104, toward the opposite side edge 102 at a non-perpendicular angle with respect to the side edge 104. A non-adhesive portion 134 is formed at an end segment 136 of the separable edge 130 which extends from the cut portion 132 to the side edge 102. The non-adhesive portion 134 may be formed as a completely cut portion divided into two sections as shown in FIG. 15A or as a single section in the form of a tear away or bridge section 138 as shown in FIG. 17.

FIGS. 18–22 depict another group of tape rolls having a completely different separable edge and non-adhesive portion according to the present invention. Although each tape roll 10 is identically constructed as the previously described tape rolls in the form of longitudinally extending strips 116 having opposed side edges 102 and 104, the shape of the non-adhesive portions differ from that described in the previous aspects.

In this aspect, the non-adhesive portion 140 extends in a general strip-like shape across the lateral extent of the roll 10 substantially completely between the side edges 102 and 104. Any step taken to deaden the adhesive on the outer or top surface of the tape roll to create the non-adhesive portions, can be implemented instead on the back surface by primary and/or secondary release coatings, as described above. A separable edge 142 is formed as a continuous or perforated cut at least partially through the roll 10 and also extends laterally between the side edges 102 and 104. In this aspect of the invention, the separable edge 142 is illustrated as having an arcuate shape by way of example only. Other non-arcuate shapes may also be employed. Alternately, the arcuate shape of the separable edge 142 may be formed in a reverse direction between the side edges 102 and 104.

Figure 18:
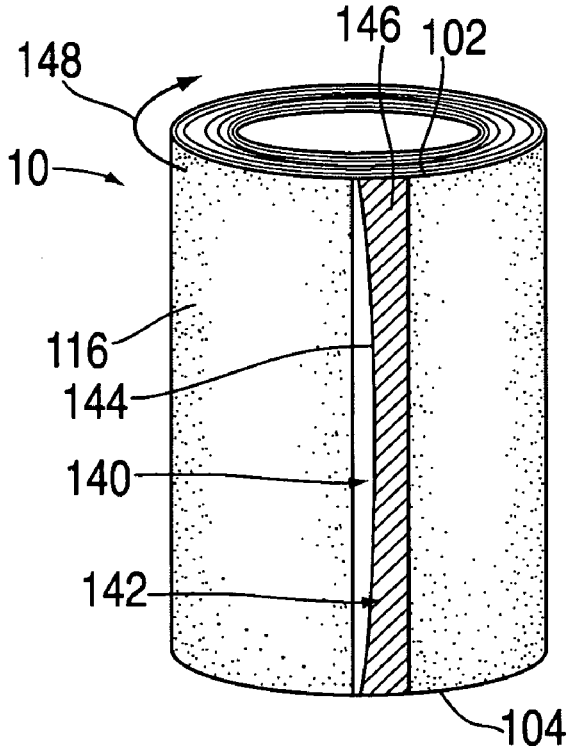
FIG. 18 is perspective view of a tape roll having a pull tab extending from side edge to side edge according to another aspect of the present invention.

The separable edge 142 separates the non-adhesive portion 140 into first and second sections 144 and 146, with the first section 144 to the left of the separable edge 142 in the orientation shown in FIG. 18 and the second section 146 located to the right of the separable edge 142. The first section 144 of the non-adhesive portion 140 is disposed at one end of the outermost strip 116 of the roll 10. The edge of the first non-adhesive section 144 can be grasped by the user at the separable edge 142, separated from the roll 10, and then unwound or separated from the roll 10 by unwinding in the direction of arrow 148.

Figure 19:
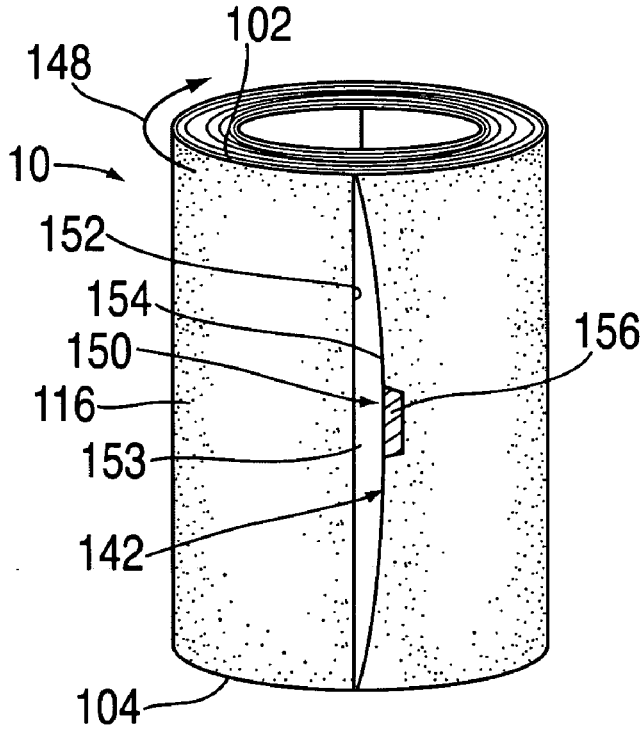
FIG. 19 is a perspective view of a tape roll having a pull tab according to another aspect of the present invention.

A modification to this configuration is shown in FIG. 19. In this aspect of the invention, the non-adhesive portion 150 has an irregular shape defined by one edge 152 extending substantially between the side edges 102 and 104 of the roll 10, an opposed arcuate edge 154 also extending between the side edges 102 and 104 which overlays the separable edge 142, and a smaller generally intermediate or centrally located section 156 which is to an opposite side of the separable edge 142 from a first section 153 of the non-adhesive portion 150. However, this pull tab construction still enables the outermost sheet 116 to be removed from the roll 10 by unwinding in the direction of arrow 148.

Figure 20:
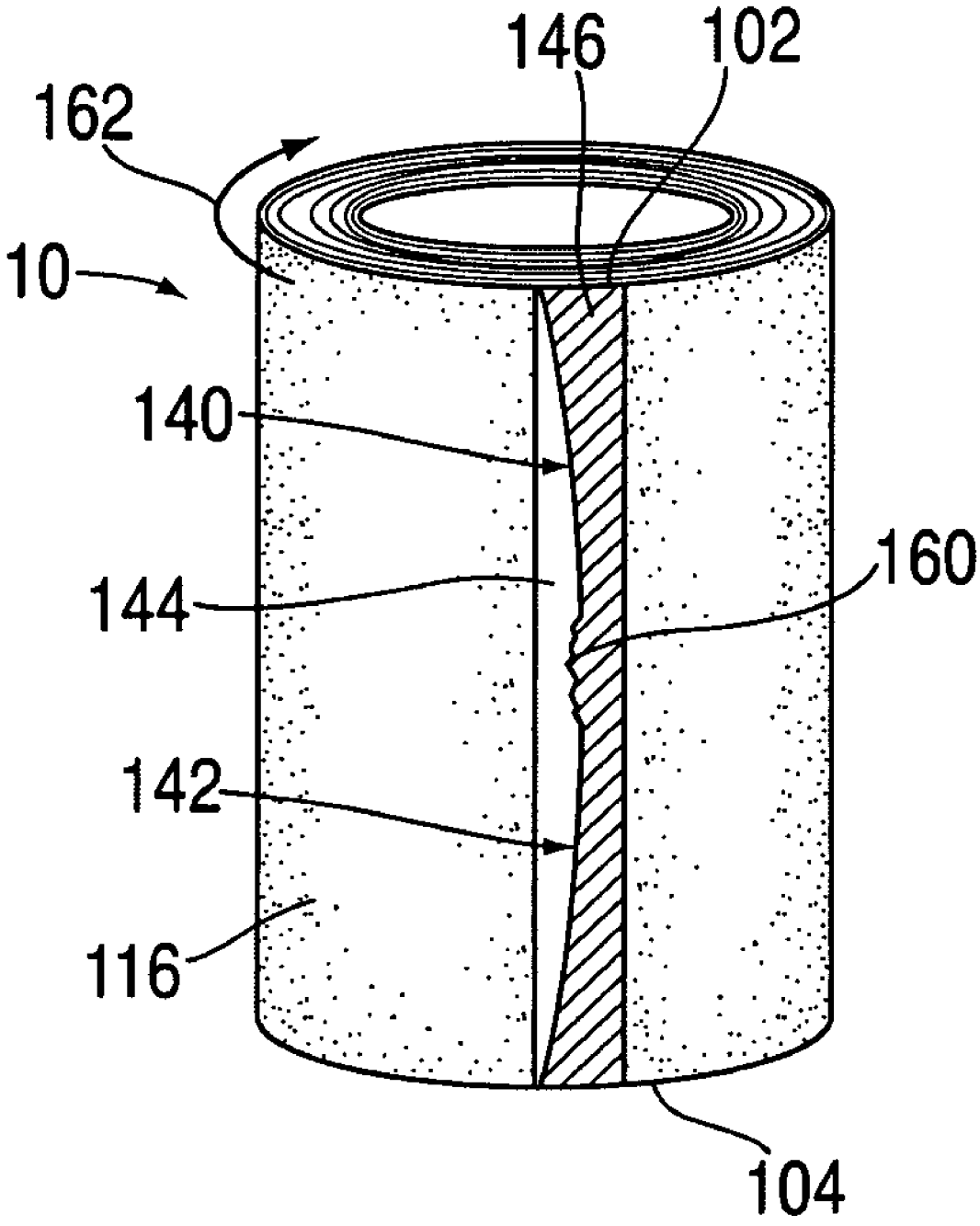
FIG. 20 is a perspective view of a tape roll having a pull tab according to yet another aspect of the present invention.

FIG. 20 represents a further modification to the tape roll 10 shown in FIG. 18 in that a tear away or bridge section 160 is formed in an intermediate portion of the separable edge 142 separating the non-adhesive sections 144 and 146 of the non-adhesive portion 140 from each other. The tear away or bridge portion 160 may be broken thereby allowing the outermost sheet 116 to be unwound in the direction of arrow 162 from the roll 10 to expose a fresh underlaying sheet.

Figure 21:
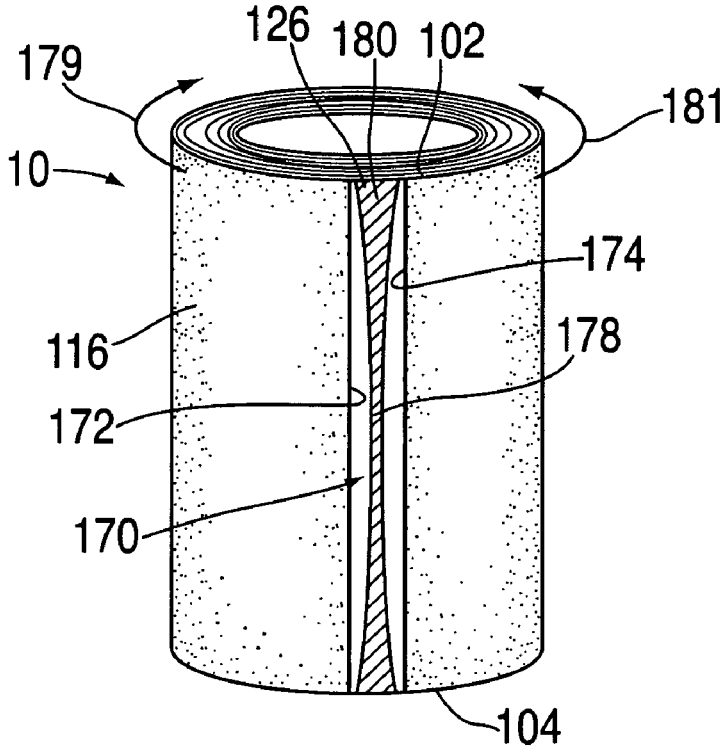
FIG. 21 is a perspective view of a tape roll having a dual edge pull tab according to another aspect of the present invention.

In the tape roll 10 shown in FIG. 21, a non-adhesive portion 170 extends laterally across the roll 10 substantially completely between the side edges 102 and 104. The non-adhesive portion is-defined by opposed edges 172 and 174. The separable edge in this aspect of the invention is defined by two spaced separable edges 176 and 178, both of which extend substantially in either a cut or perforated form from side edge 102 to side edge 104. The separable edges 176 and 178 have oppositely directed concave or convex shapes as shown in FIG. 21 and create an intermediate uncut portion 180 on the roll 10.

Figure 22:
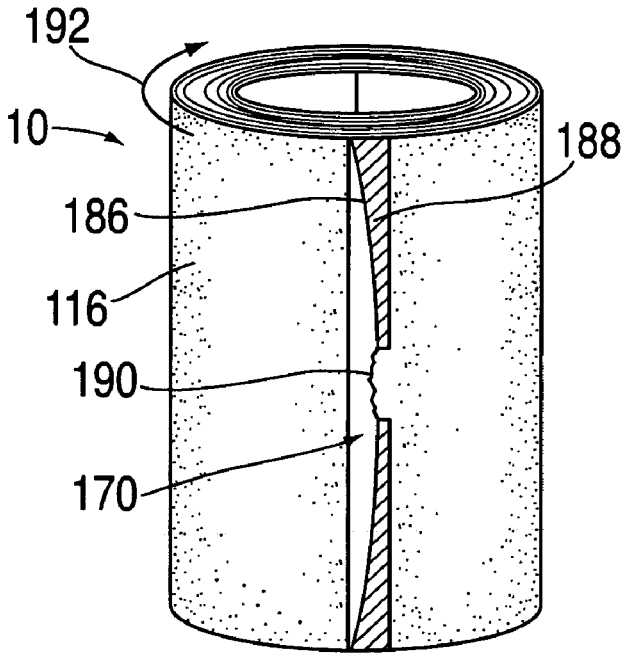
FIG. 22 is a tape roll having a pull tab which is a modification of the dual edge pull tab shown in FIG. 21.

The tape roll 10 shown in FIG. 22 is similarly formed with opposed separable edges 186 and 188 except that a continuous tear away or bridge portion 190 is formed at an intermediate portion of the separable edges 186 and 188. The-bridge portion 190 spans the opposed sections of the non-adhesive portion 170.

In the aspect of the tape roll 10 shown in FIG. 21, the outermost sheet 116 of the roll 10 may be unwound from the roll 10 in either of the direction of arrows 179 and 181 depending upon which non-adhesive portion edge 176 or 178 is grasped. In the aspect shown in FIG. 22, the outermost sheet 116 is unwound only in the direction of arrow 192 from the separable edge 186. In this aspect, the separable edge 188 forms a trailing edge of the outermost strip 116.

In summary, there has been disclosed a unique lint remover which provides non-adhesive pull tabs along the separable edges between adjacent sheets of a tape roll to facilitate easy removal of a soiled outermost sheet from the roll to expose a clean inner disposed sheet.

What is claimed is:

1. A tape roll for a lint removal roller assembly comprising:

a tape wound in a roll and formed of a substrate having opposed side edges and first and second major opposed surfaces of the tape;

an adhesive layer carried on one major surface;

the tape wound into a tape roll with the adhesive layer facing outwardly from the roll;

a separable edge extending at least partially through the roll dividing the roll into a plurality of individually separable sheets;

a non-adhesive portion laterally extending in a strip-like shape completely across said tape roll between said side edges to facilitate removal of an outermost sheet from the roll; and wherein said non-adhesive portion comprises first and second non-adhesive sections separated from one another by said separable edge.

2. The tape roll of claim 1, wherein the first section of said non-adhesive portion is disposed at one end of the outermost sheet of said roll.

3. The tape roll of claim 1, wherein said non-adhesive portion has a shape defined at least in part by a first opposing edge extending completely between said side edges of said roll and a second opposing edge extending completely between said side edges of said roll.

4. The tape roll of claim 3, wherein at least one of said first and second edges of said non-adhesive portions is arcuate in shape.

5. The tape roll of class 3, wherein said first section of the non-adhesive portion is defined between said first and second edges and said second section is defined by an intermediate portion.

6. The tape roll of claim 5, wherein said second edge of said non-adhesive portion overlies said separable edge.

7. The tape roll of class 6, wherein the intermediate portion of said non-adhesive portion is disposed only on one side of said separable edge.

8. The tape roll of claim 3, wherein said separable edge is intermediate said opposing first and second edges.

9. The tape roll of claim 3, wherein said first non-adhesive section is defined between said first opposing edge and said separable edge and said second non-adhesive section is defined between second opposing edge and said separable edge.

10. The tape roll of claim 1, further including a tear away section formed as part of an intermediate portion of one of said first and second non-adhesive sections.

11. The tape roll of claim 10, wherein the tear away section is formed along said separable edge.

12. The tape roll of claim 1, wherein the separable edge comprises two spaced separable edges.

13. The tape roll of claim 12, wherein the separable edges have oppositely directed concave or convex shapes.

14. The tape roll of claim 12, wherein said separable edges define an intermediate uncut portion on said roll.

15. The tape roll of claim 12, wherein a tear away section is formed as part of an intermediate portion of the separable edges.

16. The tape roll of claim 1, wherein the separable edge is arcuate in configuration.

* * * * *